US006799354B1

(12) United States Patent
Goradesky

(10) Patent No.: US 6,799,354 B1
(45) Date of Patent: Oct. 5, 2004

(54) CELLULAR TELEPHONE BELT CLIP AND METHOD OF RETAINING

(75) Inventor: Harold A. Goradesky, Miami, FL (US)

(73) Assignee: A. G. Findings Mfg Co, Inc., Sunrise, FL (US)

( * ) Notice: Subject to any disclaimer, the term of this patent is extended or adjusted under 35 U.S.C. 154(b) by 0 days.

(21) Appl. No.: 10/413,239

(22) Filed: Apr. 11, 2003

(51) Int. Cl.[7] ..... A45F 5/00; A45F 11/00
(52) U.S. Cl. ..... 24/3.12; 24/3.7
(58) Field of Search ..... 24/3.12, 3.7, 3.8, 24/15; 224/929, 930, 668; 206/5, 25.01, 260, 264, 265, 266, 286, 701

(56) References Cited

U.S. PATENT DOCUMENTS 757,879 A * 4/1904 Brown ..... 24/3.7
2,400,626 A * 5/1946 Brede ..... 224/668
3,091,378 A * 5/1963 O'Dwyer ..... 224/668
4,153,091 A * 5/1979 Jahn ..... 206/265
5,351,868 A * 10/1994 Beletsky et al. ..... 224/667
6,357,646 B1 * 3/2002 Gur et al. ..... 224/930

* cited by examiner

*Primary Examiner*—Robert J. Sandy
(74) *Attorney, Agent, or Firm*—Robert C. Kain, Jr.; Fleit Kain

(57) ABSTRACT

The belt clip for a cellular telephone includes a substantially rigid back plate and an expansible fabric layer (or flexible cover) partially covering the front of the back plate. The expansible layer has a degree of elasticity sufficient to secure the cell phone between the expansible layer and the back plate. A common clip (typically, an inverted U-shaped member) is mounted to the rear side of the back plate which enables the wearer to place the retained cell phone and belt clip onto his or her belt. The expansible layer may include a grip tab mounted on a top edge of the expansible layer to facilitate insertion and removal of the cell phone from the interspace between the expansible layer and the back plate. The method includes removably mounting the substantially rigid plate onto the person's belt and at least partially surrounding the cell phone with elastic material and capturing the cell phone between the material and the rigid plate.

7 Claims, 2 Drawing Sheets

CELLULAR TELEPHONE BELT CLIP AND METHOD OF RETAINING

The present invention relates to a belt clip for a cellular telephone and a method of retaining the telephone on a person's belt.

BACKGROUND OF THE INVENTION

Cellular telephones are currently quite compact, having a length of between approximately 3–4 inches and a width of approximately 1.5–2.5 inches and a thickness or depth of between 0.5–2.5 inches. Some persons, particularly males, prefer to carry their cellular telephone or cell phone on a belt about their waist. These waist belts are identified herein as a "belt." Various belt clips for cellular telephones have been devised. However, many of the belt clips require that the cell phone itself carry a certain attachment that interlocks with a complementary attachment on the belt clip. Hence, these types of cellular telephone belt clips include (a) a first clip member which captures the person's belt and (b) a complementary clip member which coacts with the first clip member permanently or semi-permanently attached to the rear side of the cell phone. For example, the first clip member may be a socket connection and the complementary member a fitted ball for the socket.

The present invention provides an almost universal belt clip for a cellular telephone which does not require any type of clip member to be permanently or semi-permanently attached to the rear side of the cell phone.

OBJECTS OF THE INVENTION

It is an object of the present invention to provide a belt clip for a cellular telephone which has a rigid back plate slightly larger than the cell phone and an expansible fabric or flexible layer on the front side of the back plate which fully or partially covers the cell phone when the cell phone is inserted intermediate between the expansible layer and the rigid back plate.

Another object of the present invention to provide a method for retaining a cellular telephone on a belt by removably mounting the substantially rigid plate on a person's belt and then at least partially surrounding the cellular telephone with elastic material, capturing the cell phone between the material and the rigid plate.

It is an additional object of the present invention to provide a belt clip for a cellular telephone which can accommodate a wide range of cell phones, that is, to accommodate a significant range of cell phones having different sizes.

SUMMARY OF THE INVENTION

The belt clip for a cellular telephone includes a substantially rigid back plate and an expansible fabric layer (or flexible expansible cover) partially covering the front of the back plate. The expansible layer has a degree of elasticity sufficient to secure the cell phone between the expansible layer and the back plate. A common clip (typically, an inverted U-shaped member) is mounted to the rear side of the back plate which enables the wearer to place the retained cell phone and belt clip onto his or her belt. The expansible layer may include a grip tab mounted on a top edge of the expansible layer to facilitate insertion and removal of the cell phone from the interspace between the expansible layer and the back plate. The method includes removably mounting the substantially rigid plate onto the person's belt and at least partially surrounding the cell phone with elastic material and capturing the cell phone between the material and the rigid plate.

BRIEF DESCRIPTION OF THE DRAWINGS

Further objects and advantages of the present invention can be found in the detailed description of the preferred embodiment when taken in conjunction with the accompanying drawings in which.

DETAILED DESCRIPTION OF THE PREFERRED EMBODIMENT

Figures 1A, 2, 3, 4A, 5, 6:
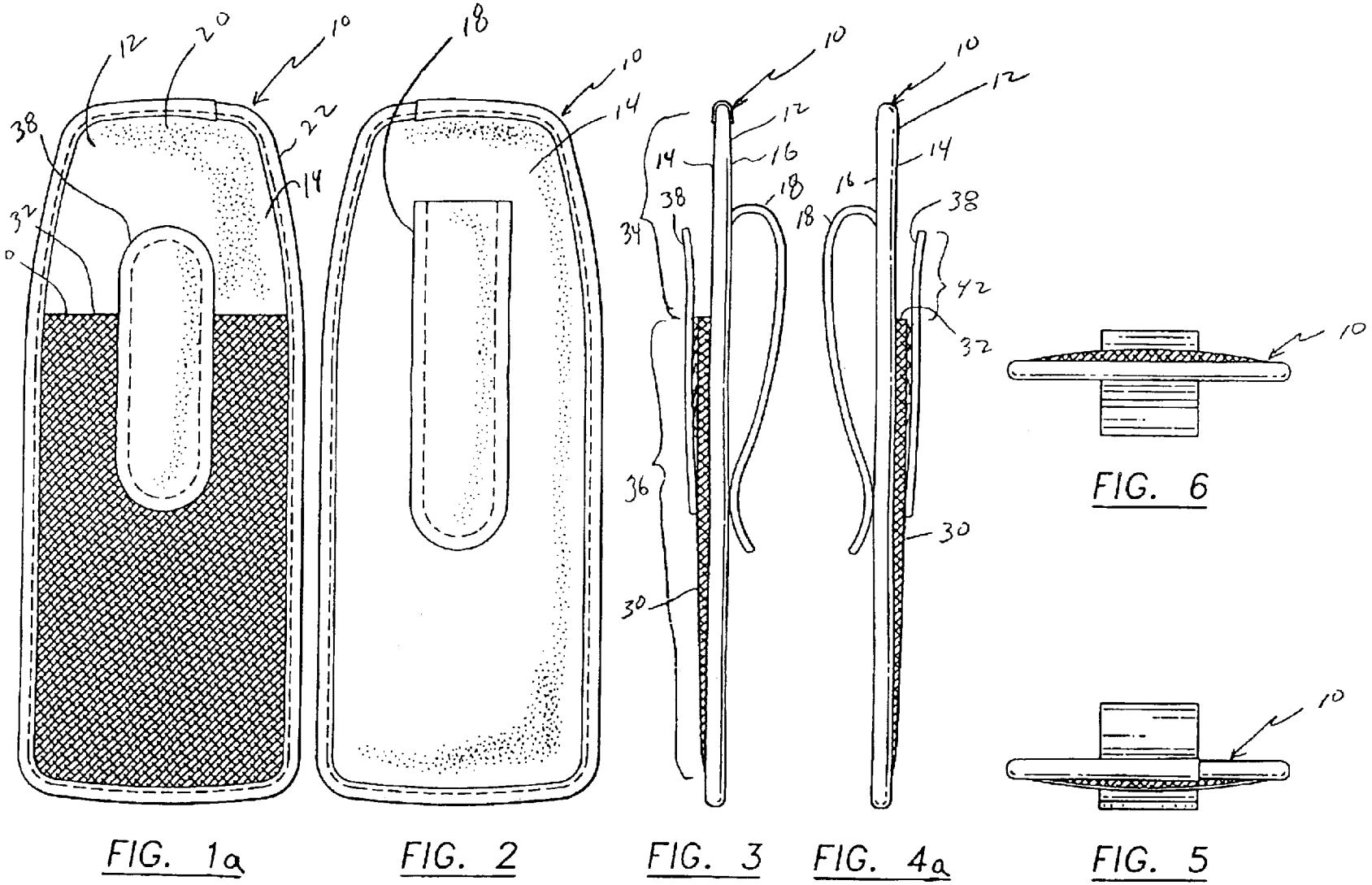
FIGS. 1*a*, 2, 3, 4*a*, 5 and 6 diagrammatically illustrate the belt clip without a cell phone, and, particularly, the front side, rear side, right side, left side, top and bottom of the cell phone carrier, respectively.

The present invention relates to a belt clip for a cellular telephone and a method for retaining the cell phone on a person's belt. FIG. 1*a* diagrammatically illustrates belt clip 10 having rigid plate 12. In the figures, similar numerals designate similar items. FIGS. 1*a*, 2, 3, 4*a*, 5 and 6 are discussed concurrently herein. Substantially rigid back plate 12 has a front side 14 and a rear side 16. A belt clip 18 is mounted to the rear side 16 of substantially rigid back plate 12. Clip 18 is substantially an inverted U-shaped clip commonly employed to removably attach items to a waist belt. Back plate 12 may be made of cardboard or plastic. It is substantially rigid. Plate 12 may be covered with a cloth material 20 sewn to the front and rear of the back plate in addition to rib or bead 22 sewn about the peripheral edge of the plate.

An expansible fabric or flexible layer 30 is attached to front side 14 of rigid back plate 12. Expansible layer 30 partially covers the front side 14 of plate 12. Layer 30 may be expansible cloth or plastic or rubber sheet. When not in use, expansible layer closely conforms and lays flat on plate 12. Edge 32 of expansible layer 30 delineates exposed back plate region 34 (see FIG. 3) in contrast to covered black plate region 36. A grip tab 38 is mounted to the forward or exposed front side of expansible fabric layer 30 at edge 32. Grip tab is centrally located (laterally) on the edge of expansible layer 30. An upper portion 42 of grip tab 38 extends beyond edge 32 of expansible layer 30. See FIG. 4*a*. Grip tab 38 is also a substantially rigid, slightly convex shaped member to enable the user to pull open layer 30 and to open the interspace 52. Grip tab 38 also facilitates removal of the phone after full insertion. The user grips the tab, pulls it away from rigid back plate 12 and grabs the phone in the interspace 52.

Figure 1B:
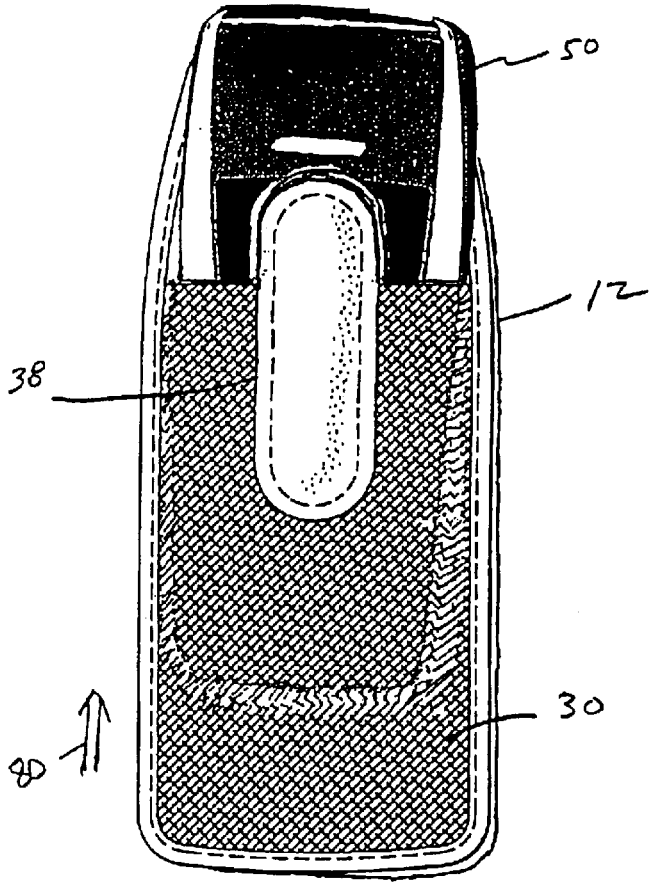
FIG. 1*b* diagrammatically illustrates the belt clip with the cell phone inserted between the expansible layer and the substantially rigid back plate.

FIG. 1*b* shows one example of a cell phone 50 placed in the interspace 52 between expansible layer 30 and back plate 12. Expansible layer 30 compresses the phone against plate 12.

To mount the belt clip on a person's belt, the person places inverted U-shaped clip 18 behind his or her belt and inserts shaped clip 18 and places the belt in clip space 60 as shown by arrow 62. Space 60 is the interspace between shaped clip 18 and the rear side 16 of rigid plate 12. To insert cell phone 50, the person either (a) places cell phone in the interspace

Figure 4B:
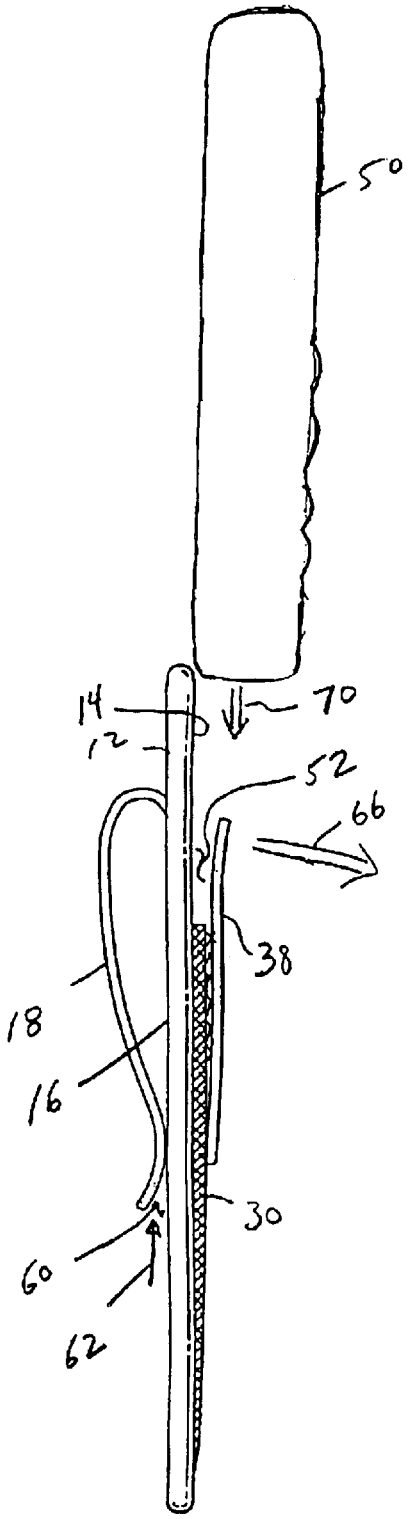
FIG. 4*b* diagrammatically illustrates the belt clip and the method of inserting the cell phone into the interspace between the expansible layer and the rigid back plate.

52, between grip tab 38 and front face 14 of rigid plate 12, and pushes the cell phone into space 52 or (b) uses his or her finger to pull grip tab 38 away from front face 14 prior to insertion of the phone in space 52. The pulling away of tab 38 enlarges space 52. In either event, grip tab 38 moves in the direction of arrow 66 (in the z dimension away from face 14) thereby enlarging interspace and insertion passage 52. Cell phone 50 is then moved downward in the direction shown by arrow 70 into interspace or insertion passage 52 thereby expanding expansible and elastic layer 30 such that it fully or partially surrounds the cell phone. A partially surrounded cell phone 50 is illustrated in FIG. 1*b*. The elastic and expansible layer has a degree of elasticity sufficient to securely retain the cell phone between the expansible layer and the back plate 12. A reasonably tight compression fit is provided by expansible layer 30. When cell phone 50 is withdrawn (in a direction opposite arrow 70 in FIG. 4*b*), the expansible layer contracts thereby creating a very thin, plate-like belt clip system without the cell phone. Hence, the person can carry the plate-like belt clip without difficulty and can insert cell phones of various sizes and shapes into the plate-like clip. The sizes of typical cell phones which can be retained by the plate-like clip are set forth above.

The expansible fabric layer can completely enclose the cell phone. However,the grip tab should be utilized for insertion and removal. Additionally, the cell phone can be removed from the clip system by upward movement in direction 80 in FIG. 1*b* at the lower edge of a cell phone in the flexible fabric layer.

The claims appended hereto are meant to cover modifications and changes within the scope and spirit of the present invention.

What is claimed is:

1. A belt clip for a cellular telephone comprising: a substantially rigid back plate having a front side and a rear side; an expansible fabric layer partially covering the front side of said back plate, said expansible layer having a degree of elasticity sufficient to securely retain said cellular telephone between said expansible layer and said back plate; and an inverted U-shaped clip, adapted to be removably mounted on a waist belt, mounted on said rear side of said back plate; and including a grip tab mounted to a top edge of said expansible layer.

2. A belt clip for a cellular telephone as claimed in claim 1 wherein said cellular telephone has a phone width and a phone length and wherein said back plate has a plate width and a plate length which are dimensionally larger than said phone width and phone length.

3. A belt clip for a cellular telephone as claimed in claim 2 wherein said top edge of said expansible layer delineates an exposed portion of said back plate in contrast to a covered portion of said back plate which is covered by said expansible layer, said grip tab extending beyond said top edge and over said exposed portion of said back plate.

4. A belt clip is claimed in claim 3 wherein said grip tab has a slight convex curve which establishes a space between the grip tab and said back plate.

5. A belt clip for a cellular telephone as claimed in claim 1 wherein said back plate is a thin plate of cardboard or plastic material and said expansible layer is sewn onto said back plate.

6. A method of retaining a cellular telephone on a person's belt comprising: removably mounting a substantially rigid plate onto said person's belt; at least partially surrounding said cellular telephone with elastic material and capturing said cellular telephone between said elastic material and said rigid plate.

7. A method as claimed in claim 6 including the step of separating said elastic from said rigid plate and forming an insertion passage therebetween and inserting, at least partially, said cellular telephone into said insertion passage prior to surrounding said cellular telephone with said elastic material.

* * * * *